US008307780B2

(12) United States Patent
Yamasaki et al.

(10) Patent No.: US 8,307,780 B2
(45) Date of Patent: Nov. 13, 2012

(54) ELECTROSTATIC COATING APPARATUS

(75) Inventors: Isamu Yamasaki, Toyota (JP); Akira Kato, Nisshin (JP); Michio Mitsui, Yokohama (JP); Kimiyoshi Nagai, Yokohama (JP)

(73) Assignees: Toyota Jidosha Kabushiki Kaisha, Toyota-shi (JP); Ransburg Industrial Finishing K.K., Yokohama-shi (JP)

( * ) Notice: Subject to any disclaimer, the term of this patent is extended or adjusted under 35 U.S.C. 154(b) by 271 days.

(21) Appl. No.: 12/740,756

(22) PCT Filed: Oct. 28, 2008

(86) PCT No.: PCT/JP2008/069550

§ 371 (c)(1),
(2), (4) Date: Apr. 30, 2010

(87) PCT Pub. No.: WO2009/057593

PCT Pub. Date: May 7, 2009

(65) Prior Publication Data

US 2010/0229792 A1 Sep. 16, 2010

(30) Foreign Application Priority Data

Nov. 2, 2007 (JP) ..... 2007-286795

(51) Int. Cl.
*B05B 5/025* (2006.01)

(52) U.S. Cl. ..... 118/628; 118/629; 118/625; 239/706

(58) Field of Classification Search ..... 118/620–640; 239/700–708, 223, 224, 690, 699; 427/457–486
See application file for complete search history.

(56) References Cited

U.S. PATENT DOCUMENTS

| | | | | |
|---|---|---|---|---|
| 4,887,770 | A * | 12/1989 | Wacker et al. | 239/703 |
| 5,947,377 | A * | 9/1999 | Hansinger et al. | 239/3 |
| 2008/0178802 | A1 * | 7/2008 | Sakakibara et al. | 118/621 |

FOREIGN PATENT DOCUMENTS

| | | | |
|---|---|---|---|
| JP | 64-11661 | A | 1/1989 |
| JP | 2006-82064 | A | 3/2006 |
| JP | 2006-110449 | A | 4/2006 |
| JP | 2007-69136 | A | 3/2007 |
| WO | WO 2006030991 | A1 * | 3/2006 |

* cited by examiner

*Primary Examiner* — Yewebdar Tadesse
(74) *Attorney, Agent, or Firm* — Kenyon & Kenyon LLP

(57) ABSTRACT

Intended is to enable an electrostatic coating apparatus including a plurality of needle electrodes formed in an annular shape and having a blot preventing function, to prevent the generation of a spark discharge reliably, in case an arbitrary needle electrode approaches an earth element, and to keep the intensity of a generated electrostatic field properly. A coating gun comprises a blot preventing device including a ring-shaped electrode unit having a plurality of needle electrodes protruding radially at a substantially equal spacing radially outward from an annular base member, and a high-voltage generator for applying a high voltage to the electrode unit. The needle electrodes are connected in parallel with the high-voltage generator through individual resistors, block-by-block resistors and built-in resistors.

6 Claims, 11 Drawing Sheets

(a)

(b)

(a)

(b)

ELECTROSTATIC COATING APPARATUS

This is a 371 national phase application of PCT/JP2008/069550 filed 28 Oct. 2008, claiming priority to Japanese Patent Application No. 2007-286795 filed 2 Nov. 2007, the contents of which are incorporated herein by reference.

TECHNICAL FIELD

The present invention relates to an electrostatic coating apparatus.

BACKGROUND ART

In the rotary atomizing electrostatic coating apparatus, when the paint adheres around the nozzle for spraying the paint, the paint scatters around with forced by the centrifugal force generated by high-speed rotation of the bell cup or by the air blown out from the shaping air ring, which is called a spit. When the paint adheres to the painted surface, the poor paint quality occurs. Thus, in the rotary atomizing electrostatic coating apparatus, in order to keep good paint quality, required is the technique of preventing the paint (blot) from adhering to the periphery of the nozzle.

In the conventional technique, needle electrodes are provided around the nozzle to form electrostatic fields around the electrodes so that the electrostatic repulsion is acted on the paint mist floating around the electrodes, keeping it away from the nozzle, thereby preventing the paint from adhering to the nozzle.

JP 2006-82064 A discloses the rotary atomizing electrostatic coating apparatus, which includes the needle electrodes radiating from the ring electrode, arranged at the periphery thereof to form uniform electrostatic field around the nozzle.

Referring FIGS. 7 to 10, the conventional blot preventing device 51 is explained below.

As shown in FIG. 7, the device 51 has an electrode part 54 including a ring electrode 52 and multiple (ten) needle electrodes 53 (53*a*, 53*b*, 53*c*, 53*d*, 53*e*, 53*f*, 53*g*, 53*h*, 53*i*, 53*j*) radiating from the ring electrode 52 each of which is spaced at the substantially equal distance, and the electrode part 54 is connected with a high voltage generator 56.

As shown in FIG. 8, in the actual using, the electrode part 54 is fixed to a coating gun 55. In detail, the electrode part 54 is arranged at the periphery of a shaping air ring 55*b* located backside of a bell cup 55*a*.

As shown in FIG. 8, the high voltage generator 56 is built in the coating gun 55, electrically connected to a built-in air motor 55*c* and to a built-in wire 56*a*.

The high voltage generator 56 is supplied with 24 V from the external source, in which the voltage is raised to about 90 kV. The high voltage generated in the generator 56 is applied to the air motor 55*c*.

The air motor 55*c* is composed of conducting members and contacts the shaping air ring 55*b* which is also composed of conducting members. Thus, the air motor 55*c* and the shaping air ring 55*b* are electrically connected. The voltage applied to the air motor 55*c* is also applied to the bell cup 55*a*.

The electrode part 54 is fixed to the ring 55*b*, so that they are electrically connected. The voltage applied to the ring 55*b* is applied to the electrode part 54.

As described above, the electrode part 54 is electrically connected to the high voltage generator 56 built in the gun 55, to which high voltage applied.

As shown in FIG. 9, the high voltage generated by the generator 56 is applied to the electrode part 54, whereby the needle electrodes 53 form the high-intensity electrostatic field (electric barrier) toward a grounded body 57. The paint mist discharged from the bell cup 55*a* of the gun 55 is controlled with the electrostatic repulsion, keeping the paint away from the gun 55, thereby preventing the paint from adhering to the gun 55 (especially to proximate portions to the bell cup 55*a*, shaping air ring 55*b*).

As shown in FIG. 9, when the electrode part 54 is apart from the grounded body 57 by the normal distance (in the normal state), the needle electrodes 53 foam the electrostatic field toward the grounded body 57 and the corona discharge occurs in which the slight current about a few μA flows from the electrodes 53 to the grounded body 57.

Unfortunately, as shown in FIG. 10, when the needle electrodes 53 come closer to the grounded body 57 beyond the proper range (namely, the distance between them becomes not more than the distance L1), the electric discharge amount increases and the discharge energy becomes higher, so that the discharge phase is shifted to the spark discharge from the corona discharge.

As depicted in FIG. 10, for example, when the distance between the needle electrode 53*d* and the grounded body 57 becomes the distance L2 (L2<L1, which is not more than the normal distance), the current concentrates on the electrode 53*d*, thereby increasing the electric energy in the electrode 53*d* and unfortunately generating the spark from the electrode 53*d* to the grounded body 57.

The conventional device 51 having the needle electrodes 53 is controlled to prevent the spark discharge. For instance, the discharge current is monitored and when the higher current than the predetermined value is detected, the power supply to the high voltage generator 56 is stopped or lowered.

In other case, when the electrode 53*d* come closer to the grounded body 57 beyond the proper range, the current concentrates on the electrode 53*d*, thereby dropping the voltages applied to the other electrodes (apart from the electrode 53*d*). Mentioned to the electrodes 53*c* and 53*e*, the distances from the grounded body 57 are the distance L3, which is in the proper range, however, the voltages dropped caused by the electrode 53*d*, whereby the electrostatic fields generated therefrom become less than the proper intensity. Moreover, the similar situation occurs in the other electrodes. As a result, the performance of the device 51 (blot preventing performance) is lowered.

The conventional device 51 can be applied to the case that the distance between the coating object and the gun 55 is easily kept in the proper range, for example when coating the exterior of the vehicle body. However, when coating the inside of the complex configuration such as the interior of the vehicle body, the gun 55 easily moves close to the coating object (flame or the like) beyond the proper range. In the close situation, the spark discharge or the voltage drop may occur, so that the measure is needed such as to stop the power supply to the electrodes 53. In such situation, the coating operation is interrupted, and the performance of the device 51 may fail to be kept properly.

DISCLOSURE OF INVENTION

Problems to be Solved by the Invention

The objective of the present invention is to provide an unexpected electrostatic coating apparatus including a blot preventing device provided with multiple needle electrodes enabled to prevent the spark discharge if the electrodes approach the grounded body and to keep the electrostatic field proper intensity.

Means of Solving the Problems

The first aspect of the present invention is an electrostatic coating apparatus, including a blot preventing device which contains a ring electrode provided with multiple needle electrodes radiating from a ring base and a high voltage generator applying high voltage to the ring electrode, in which the needle electrodes are parallelly connected to the high voltage generator through resistors.

Due to the above structure, when the current concentrates on any needle electrode, the voltage applied to the electrode is dropped largely, thereby preventing the spark discharge. Moreover, in the other electrodes, the voltages applied thereto are not dropped largely, so that the intensities of the electrostatic fields are maintained. Therefore, the blot preventing performance of the other electrodes is provided properly.

In the advantageous embodiment of the present invention, the electric resistances of the resistors are more than 1 MΩ.

Thus, the necessary voltage-drop amount is obtained for preventing the spark discharge on a needle electrode. In the other electrodes, the necessary voltage-drop amount is obtained for keeping the proper electrostatic fields.

In the preferable embodiment of the present invention, the needle electrodes are parallelly connected to the high voltage generator through individual resistors.

Due to the above structure, when the current concentrates on any needle electrode, the voltage applied to the electrode is dropped largely, thereby preventing the spark discharge. Moreover, in the other electrodes, the voltages applied thereto are not dropped largely, so that the intensities of the electrostatic fields are maintained. Therefore, the blot preventing performance of the other electrodes is provided properly.

Preferably, in the embodiment of the present invention, the electric resistances of the individual resistors are more than 1 MΩ.

Thus, the necessary voltage-drop amount is obtained for preventing the spark discharge on a needle electrode. In the other electrodes, the necessary voltage-drop amount is obtained for keeping the proper electrostatic fields.

In the other embodiment of the present invention, the needle electrodes are divided into multiple blocks and in the each block the needle electrodes are connected parallelly to the high voltage generator through block-by-block resistors.

Due to the above structure, when the current concentrates on any needle electrode, the voltage applied to the electrode is dropped largely, thereby preventing the spark discharge. Moreover, in the other electrodes, the voltages applied thereto are not dropped largely, so that the intensities of the electrostatic fields are maintained. Therefore, the blot preventing performance of the other electrodes is provided properly.

Preferably in the preferable embodiment of the present invention, the electric resistances of the block-by-block resistors are more than 1 MΩ.

Thus, the necessary voltage-drop amount is obtained for preventing the spark discharge on a needle electrode. In the other electrodes, the necessary voltage-drop amount is obtained for keeping the proper electrostatic fields.

The second aspect of the present invention is an electrostatic coating apparatus, in which the high voltage generator is composed of multiple generators, the needle electrodes are divided into the same number of blocks, and the needle electrodes in each block are connected to the each generator.

Due to the above structure, the voltage fluctuation occurred in a needle electrode does not influence on the other electrodes.

Effect of the Invention

According to the present invention, if the any electrodes approach to the grounded body, the spark discharge is prevented and the other electrodes keep the electrostatic fields proper intensities.

THE BEST MODE FOR CARRYING OUT THE INVENTION

First Embodiment

The best mode for carrying out the present invention, or a blot preventing device 1, is described below.

Figure 1:
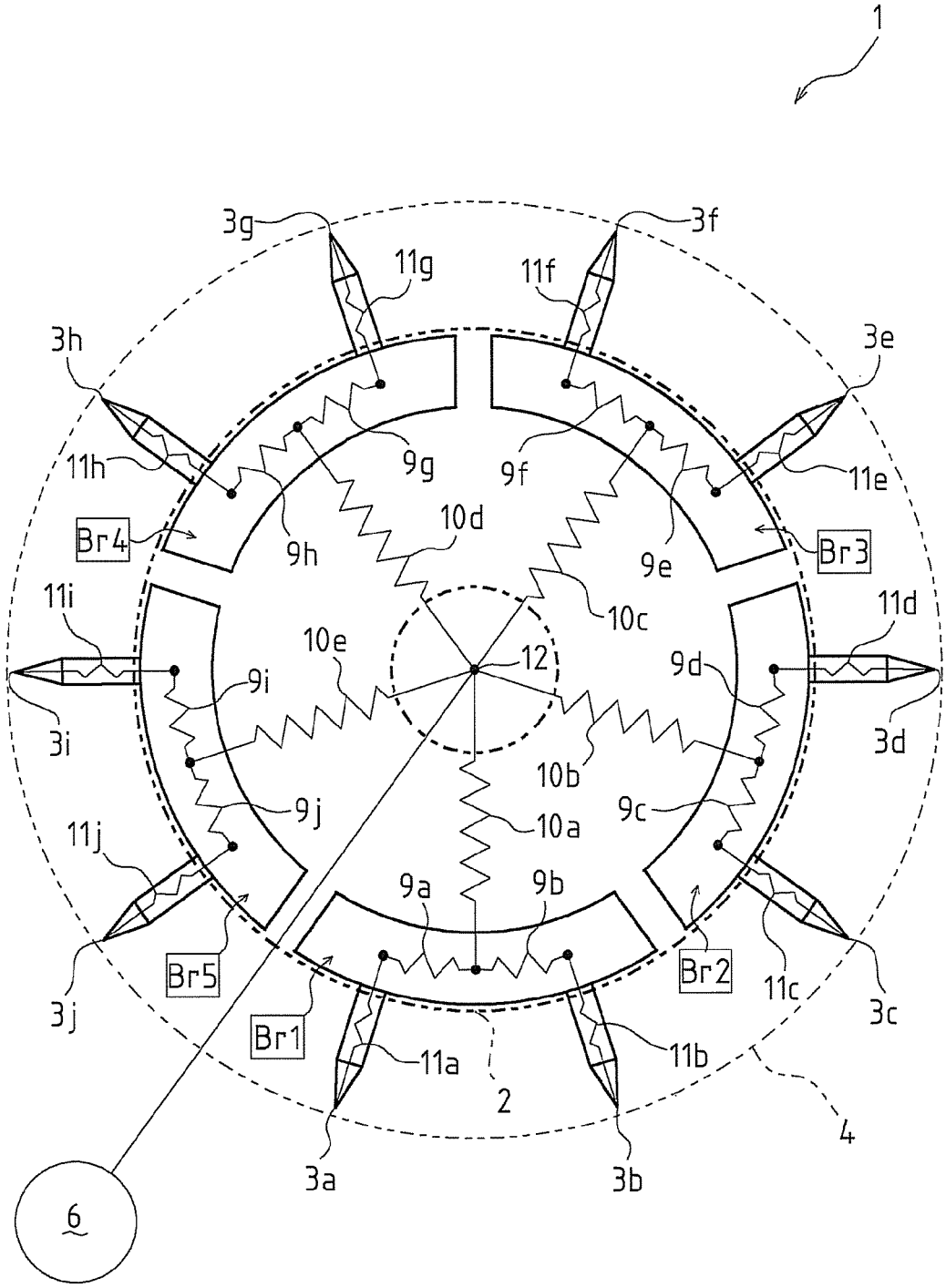
FIG. 1 depicts a first embodiment showing a blot preventing device according to the present invention.

As shown in FIG. 1, the device 1 includes a ring electrode part 4 provided with multiple (ten) needle electrodes 3 (3*a*, 3*b*, 3*c*, 3*d*, 3*e*, 3*f*, 3*g*, 3*h*, 3*i*, 3*j*) radiating from a ring base 2, each of which is arranged at spacing same distance from the adjacent electrodes.

Figure 2:
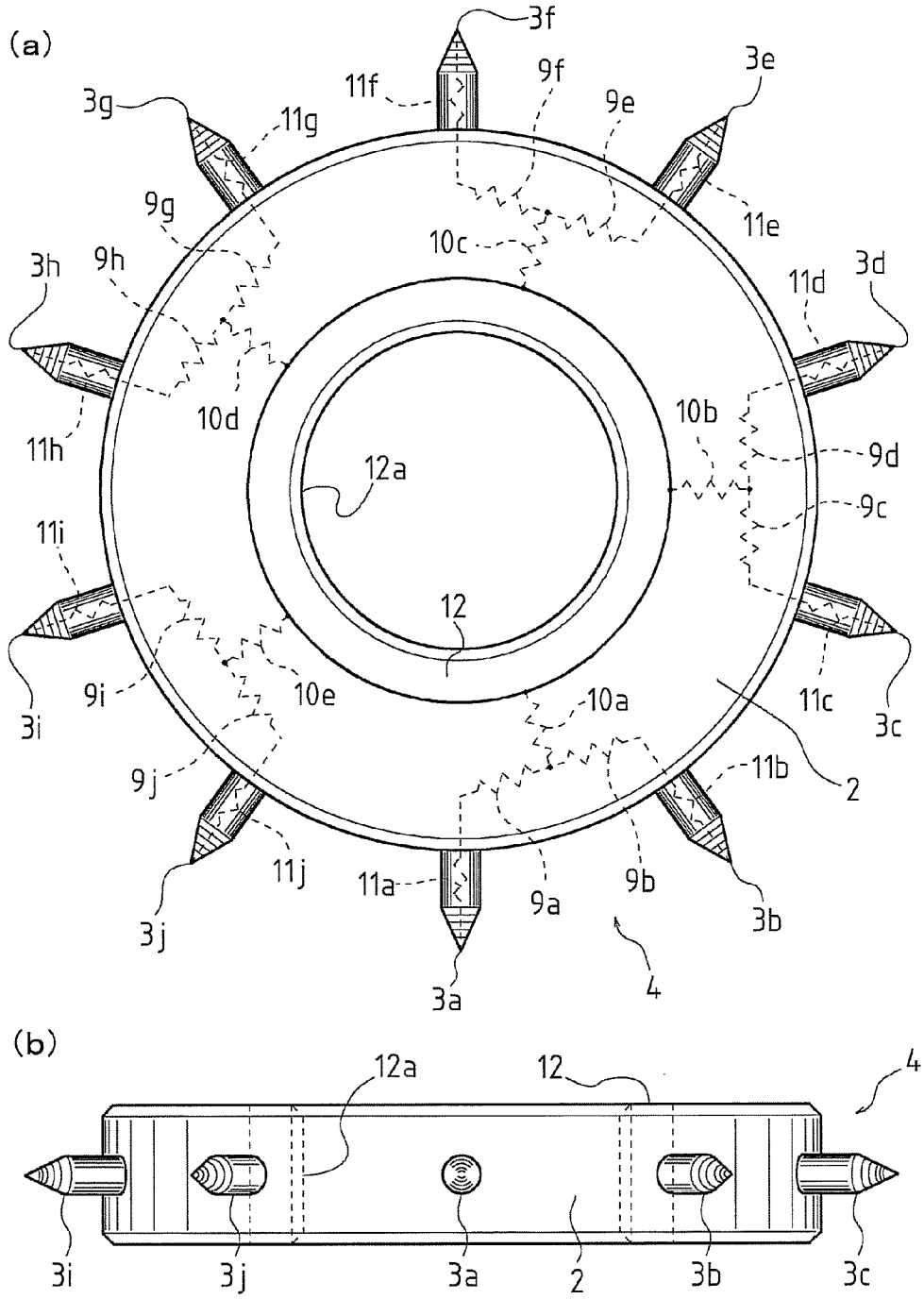
FIG. 2 is a plan view and a side view illustrating a blot preventing ring according to the present invention.

As shown in FIGS. 1, 2, the base 2 is composed of an insulator and foamed in the ring shape, which supports the electrodes 3 radiately and at the same spacing. Note that the base 2 does not function as the electrode.

The base 2 has wires and multiple resistors (individual resistors 9, block-by-block resistors 10).

As shown in FIGS. 1, 2, one ends of the wires built in the base 2 are connected to an input terminal 12. The other ends of the wires are connected to the electrodes 3*a* to 3*j*. As depicted in FIG. 2, the input terminal 12 is a conducting material configured in the ring shape to engage in the ring base 2, and a thread portion 12*a* is formed in the inside of the input terminal 12.

Figure 3:
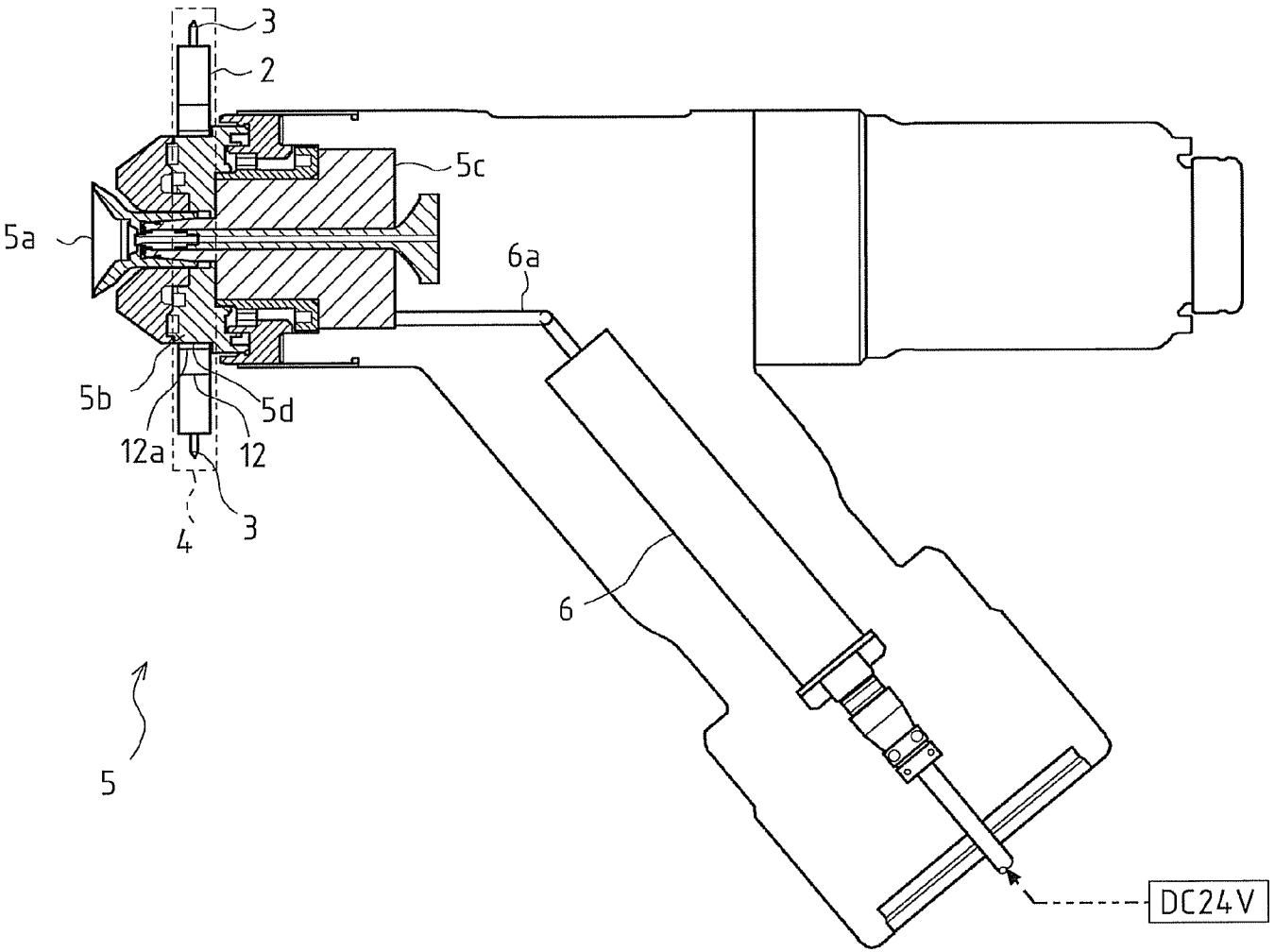
FIG. 3 is a side sectional view illustrating an electrostatic coating apparatus including the blot preventing device.

As shown in FIG. 3, a coating gun 5 as the electrostatic coating device includes a bell cup 5*a*, a shaping air ring 5*b*, an air motor 5*c*, and a high voltage generator 6. The outside of the shaping air ring 5*b* is formed with a thread portion 5*d* threadably attached to the thread portion 12*a*, whereby the electrode part 4 is fixed and electrically connected to the shaping air ring 5*b*.

To the shaping air ring 5*b*, high voltage (about 60 to 90 kV) is applied by the generator 6 and the base 2 touches the ring 5*b*, whereby the input terminal 12 becomes a contact point, so that the needle electrodes 3 connected to the terminal 12 via the resistors 9, 10 are applied by the high voltage generated in the generator 6.

The internal structure of the electrode part 4 is explained below.

As shown in FIGS. 1, 2, the electrode part 4 has five blocks (Br1, Br2, Br3, Br4, Br5) dividing the wires in the base 2, and two electrodes 3 are arranged in one block. The blocks Br1 to Br5 are connected in a parallel manner to the terminal 12 via the resistors 10 (10*a*, 10*b*, 10*c*, 10*d*, 10*e*). The resistors 10 have high electric resistances, 1 MΩ or more.

The electrodes 3*a* to 3*j* are divided into blocks Br1 to Br5 including the same number of (two) electrodes 3, in which the electrodes are connected to the generator 6 through the resistors 10*a* to 10*e* in a parallel manner.

The structure containing the resistors 10 provides that when the current concentrates on one electrode, the voltage drop in the electrode is increased, thereby preventing the spark discharge. Further, in the other electrodes, the voltage-drops are small, preventing the electrostatic fields from lowering, thereby enabled to maintain the blot preventing performance.

In the embodiment, the electrode part 4 is divided into five blocks, however, the dividing number is not limited and adjusted in accordance with the number of the needle electrodes, the size of the coating gun or the like.

In the inner wires of the blocks Br1 to Br5, the electrodes 3*a* to 3*j* are parallelly connected to the resistors 10*a* to 10*e* through the resistors 9 (9*a*, 9*b*, 9*c*, 9*d*, 9*e*, 9*f*, 9*g*, 9*h*, 9*i*, 9*j*). The resistors 9*a* to 9*j* have high electric resistances, 1 MΩ or more.

In other words, the needle electrodes 3*a* to 3*j* are connected to the contact point (input terminal 12) to the high voltage generator 6 through the individual resistors 9*a* to 9*j*, respectively.

Due to the above-explained structure provided with the individual resistors 9 with respect to the needle electrodes 3, when the current flows concentrating on one electrode, the voltage-drop in the electrode is increased, thereby preventing the spark discharge. Further, in the other electrodes, the voltage-drops are small, preventing the electrostatic fields from lowering, thereby enabled to maintain the blot preventing performance.

Moreover, in the inner wires of the needle electrodes 3*a* to 3*j*, the electrodes have the built-in resistors 11 (11*a*, 11*b*, 11*c*, 11*d*, 11*e*, 11*f*, 11*g*, 11*h*, 11*i*, 11*j*), respectively, and these resistors 11 are connected in a parallel manner to the input terminal 12. The resistors 11 have high electric resistance more than 1 MΩ.

As described above, the gun 5 has the generator 6, the electrode part 4 connected to the generator 6 and provided with the electrodes 3*a* to 3*j* each of which radiates from the base 2 to the radiately outward and is arranged in such manner that the electrode is spaced out with respect to the adjacent electrodes, and the device 1. The electrodes 3*a* to 3*j* are connected in a parallel manner to the generator 6 via the resistors 11*a* to 11*j* built in the electrodes, respectively.

Thus, when the current concentrates into one needle electrode, the voltage thereof is highly dropped, so that the spark discharge is prevented from occurring. Further, in the other electrodes, the voltage-drops occur in a small amount, so that the electrostatic fields formed by the electrodes are not weakened, and the performances of the blot preventing in the other electrodes are maintained properly.

Figure 4:
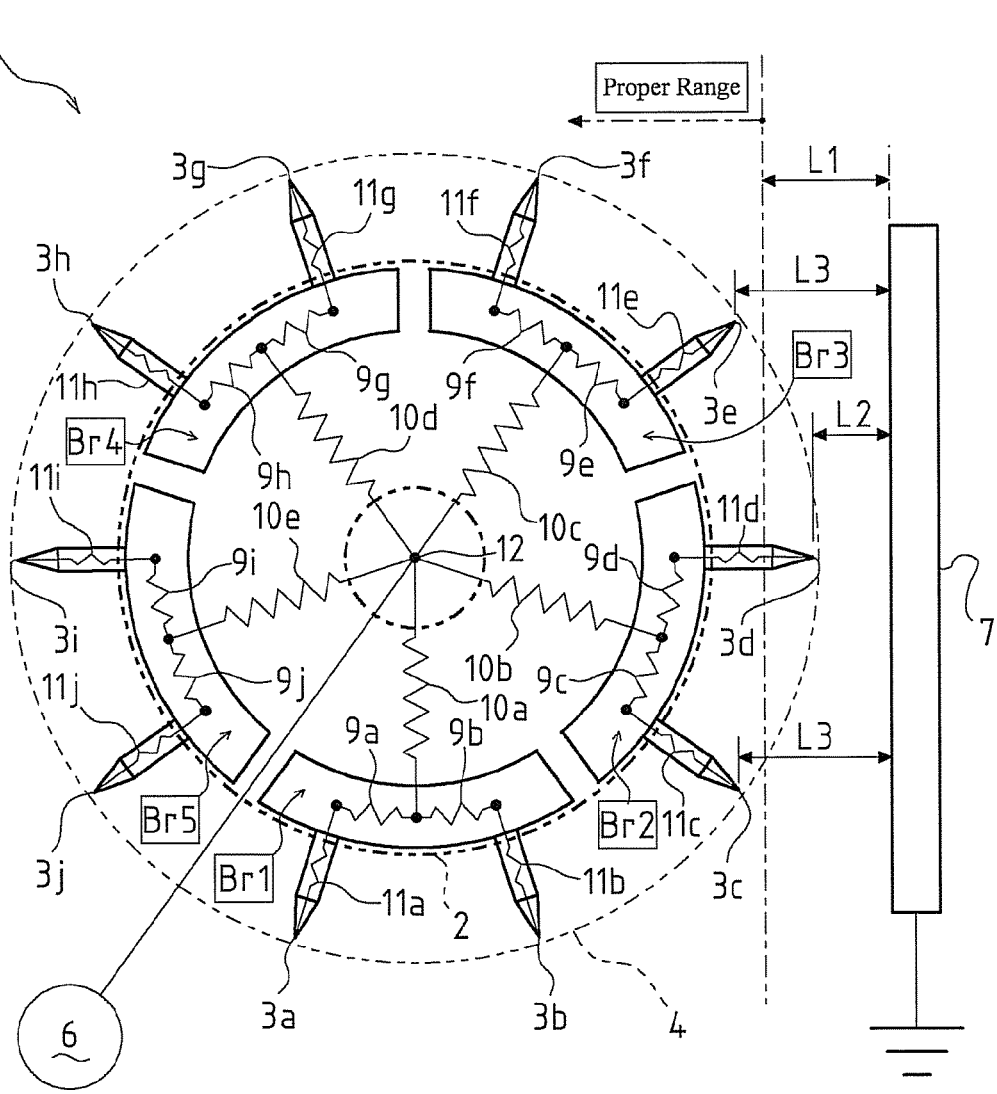
FIG. 4 depicts an approaching state of needle electrodes and a grounded body.

As shown in FIG. 4, for example, the electrode 3*d* in the block Br2 is connected to the generator 6 through the three resistors; the block-by-block resistor 10*b*, the individual resistor 9*d*, and the built-in resistor 11*d*. In this case, the resistors 9*d*, 10*b*, 11*d* have higher electric resistance than 1 MΩ.

The above structure provides that when the electrode 3*d* approaches to the grounded body 7 and the discharge current concentrates on the electrode 3*d*, the voltage-drops occurred in the resistors 9*d*, 10*b*, 11*d* make the applied voltage to the electrode 3*d* is lowered according to the amount of discharge current. Here, as to the electrode 3*c* in the same block Br2, the voltage drop of the resistor 10*b* acts thereon, so that the applied voltage lowers.

The electrode 3*c* is approached to the grounded body 7 in response to the approach of the electrode 3*d*, so that it is advantageous to lower the applied voltage to the electrode 3*c*, in this respect, there is a merit to divide the electrodes 3 into multiple blocks.

The division of the electrodes 3 into multiple blocks lowers the influence of the voltage drop occurred in one block (e.g. block Br2) on the different blocks. In the electrodes 3*a*, 3*b*, 3*e* to 3*j* belong to the blocks Br1, Br3 to Br5 apart from the block Br2 including the electrode 3*d*, which approaches to the grounded body 7, they keep the proper electrostatic fields, thereby keeping the blot preventing performance of the device 1. In this respect, the division of the electrodes 3 into multiple blocks also gives a merit.

Figure 5:
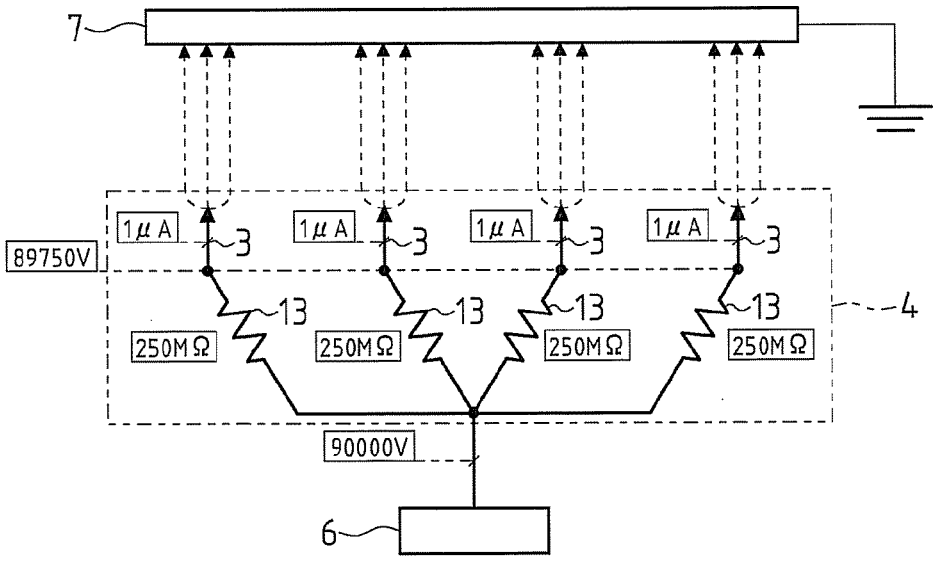
FIG. 5 depicts a voltage drop of the blot preventing device.
Figure 5:
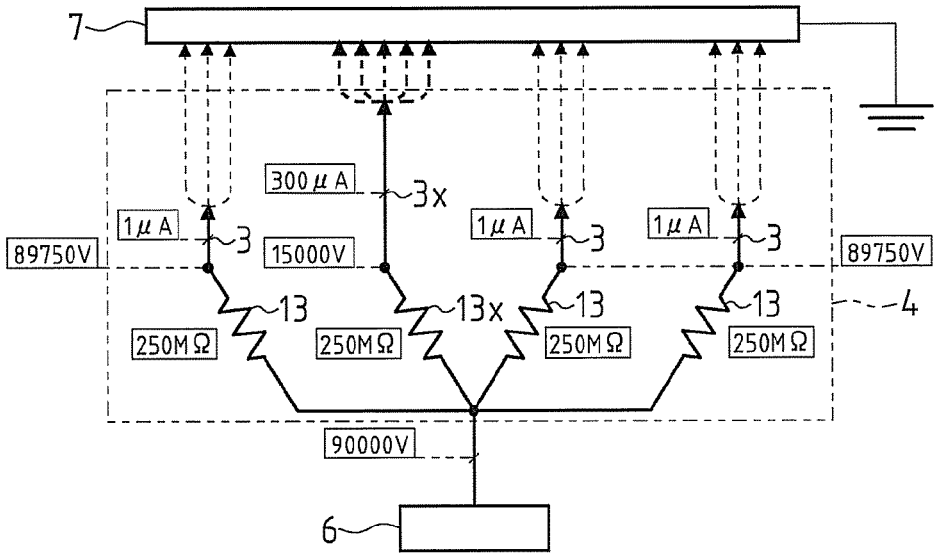
Figure 11:
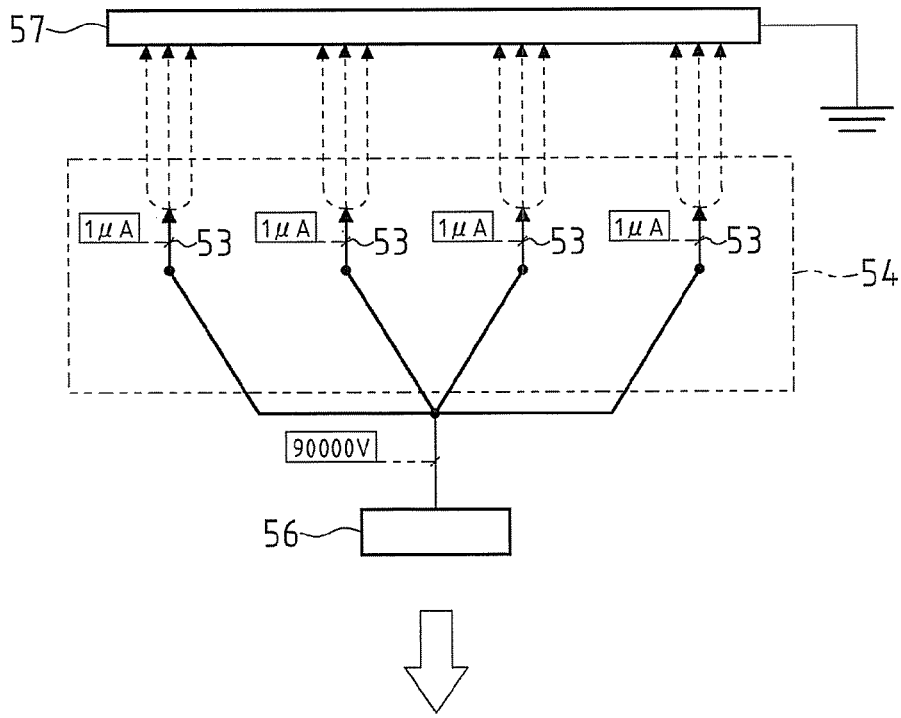
FIG. 11 depicts a voltage drop pf the conventional blot preventing device.
Figure 11:
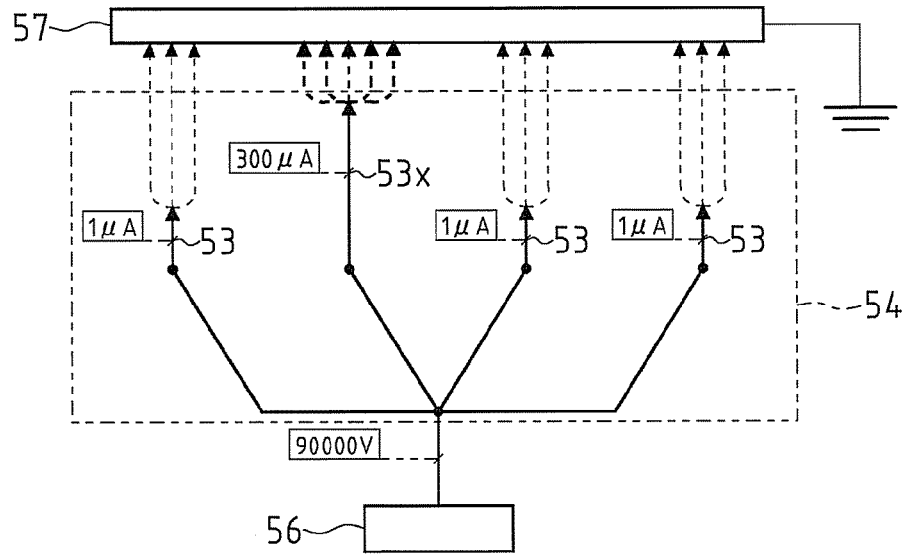

Referring FIGS. 5, 11, the effects given by the embodiment are explained in which the needle electrodes 3 and the high voltage generator 6 are connected via the resistors 12 having the high electric resistance (which is defined as 1 MΩ or more resistance).

FIG. 5 depicts the structure of the electrode part 4 schematically; the electrodes 3 are connected to the generator 6 via the resistors 13 having 50 MΩ resistance. FIG. 11 depicts the structure of the conventional electrode part 54 schematically, in which the electrodes 53 are directly connected to the generator 56.

The example shown in FIG. 5, in which the electrodes 3 are connected to the generator 6 generating 90000 V and 1 μA current flows between the electrodes 3 and the grounded body 7, is compared with the example shown in FIG. 11, in which the electrodes 53 are connected to the generator 6 generating 90000 V and 1 μA current flows between the electrodes 53 and the grounded body 57.

As shown in FIG. 11(*a*), in the electrode part 54, there are no resistors between the generator 6 and the electrodes 53. In the state where there exists the proper distance between the electrodes 53 and the grounded body 57, the electrodes 53 are applied the high voltage (90000 V) by the generator 56. Thus, in the proper state, the electrodes 53 form the electrostatic fields toward the grounded body 57, and corona discharge occurs to flow slight current GRA current).

However, as shown in FIG. 11(*b*), the electrode 53*x* that is one of the electrodes 53 approaches to the grounded body 57 beyond the proper range, and the corona discharge (e.g. around 300 μA) occurs from the electrode 53*x* to the grounded body 57. Thus, if the discharge current becomes higher, the discharge may be switched to the spark discharge from the corona discharge. Therefore, when detecting the high current, the measure for safety is adopted such as the breaker of the power supply.

Furthermore, when the high current flows in the electrode 53*x*, whereby the other electrodes 53 are influenced because there are no resistors in the system, so that the voltages applied to the other electrodes 53 are lowered and they do not keep the proper electrostatic fields.

In other words, as to the conventional blot preventing device 51 including the electrode part 54, the blot preventing performance is kept in the case that the electrodes 53 are properly apart from the grounded body 57, however, if the electrodes 53 approach to the grounded body 57 beyond the proper distance, it is necessary to stop the operation when the electrodes 53 come close to the grounded body 57, thereby preventing the smooth operation.

Contrastingly, as shown in FIG. 5(*a*), as to the electrode part 4, the resistors 13 are arranged between the generator 6 and the electrodes 3. When the electrodes 3 keep the proper distance from the grounded body 7, the corona discharge occurs from the electrodes 3 to the grounded body 7, so that the slight (1 μA) current flows and the electrostatic fields are fowled from the electrodes 3 toward the grounded body 7. Here, in the resistors 13 having 250 MΩ resistance, and the voltage drops by 250 V, so that the electrodes 3 are applied by the voltage (89750 V) subtracted by the voltage drop (250 V) in the resistors 13 from the applied voltage (90000 V) by the generator 6. Thus, in the electrodes 3, the voltage-drops occur in the proper using state and the applied voltage to the each electrode 3 is lower than the conventional one, however, the sufficient voltage is maintained to form the electrostatic field.

Furthermore, as shown in FIG. 5(*b*), the electrode 3*x* that is one of the electrodes 3 approaches to the grounded body 7 beyond the proper range, and the corona discharge (e.g. 300 μA) occurs from the electrode 3*x* to the grounded body 7. In the resistor 13*x* connected with the electrode 3*x*, the voltage-drop increase with respect to the current, and the drop amount becomes 75000 V, as a result, the applied voltage to the electrode 3*x* becomes 15000 V. In such case, if the discharge current becomes higher, the applied voltage to the electrode 3*x* is lowered to avoid the increase of the discharge energy, thereby preventing the spark discharge from occurring.

As explained above, the more the discharge current increases, the higher the voltage-drop in the resistor 13 becomes, and the voltage applied to the electrodes 3 is lowered to prevent the spark discharge, so that if the electrodes 3 approach to the grounded body 7 beyond the proper range, the discharge state is not switched form the corona discharge to the spark discharge, therefore, it is not necessary to break the power supply.

Note that in order to increase the voltage-drops in the resistors 13 sufficiently, the electric resistances of the resistors 13 should be set as the high values. In the embodiment, referring to the example in which the resistors 13 have the 250 MΩ resistance, the blot preventing device 1 has the resistors 9, 10, 11 each of which has the 1 MΩ or more resistance so that the combined resistance of them satisfies sufficiently high value.

Moreover, even if the huge current flows in the electrode 3*x*, every electrode 3 is connected to the resistor 13 and the other electrodes 3 are not influenced, whereby the voltages applied to the other electrodes 3 are kept from lowering and the proper electrostatic fields are maintained.

Therefore, in the electrode 3*x*, the voltage-drop is obtained to the certain extent that the spark discharge is prevented from occurring. Further, the voltage-drops of the other electrodes 3 are in the range where the blot preventing performance is maintained.

Due to the electrode part 4 of the present invention, it is not necessary to stop the operation at the time that the electrodes 3 approach to the grounded body 7, because the spark discharge does not occur even if the electrodes 3 come close to the grounded body 7 and the other electrodes 3 keep the proper performance of blot preventing. Therefore, the blot preventing device 1 of the present invention solves the problems in coating the interior of the vehicle body, and the coating gun 5 including the device 1 can be utilized to paint the inner parts of the vehicle body or the like.

In the embodiment, the electrodes 3 are connected via three types of resistors, however the structure of the resistors is not limited and the other configurations may be employed, for example, the resistors combining the individual resistors 9 and the built-in resistors 11 and having the total resistance of the individual resistor 9 and the built-in resistor 11, or the more resistors connected to the electrodes 3.

Second Embodiment

Below, a blot preventing device 21 as the second embodiment of the present invention is explained.

Figure 6:
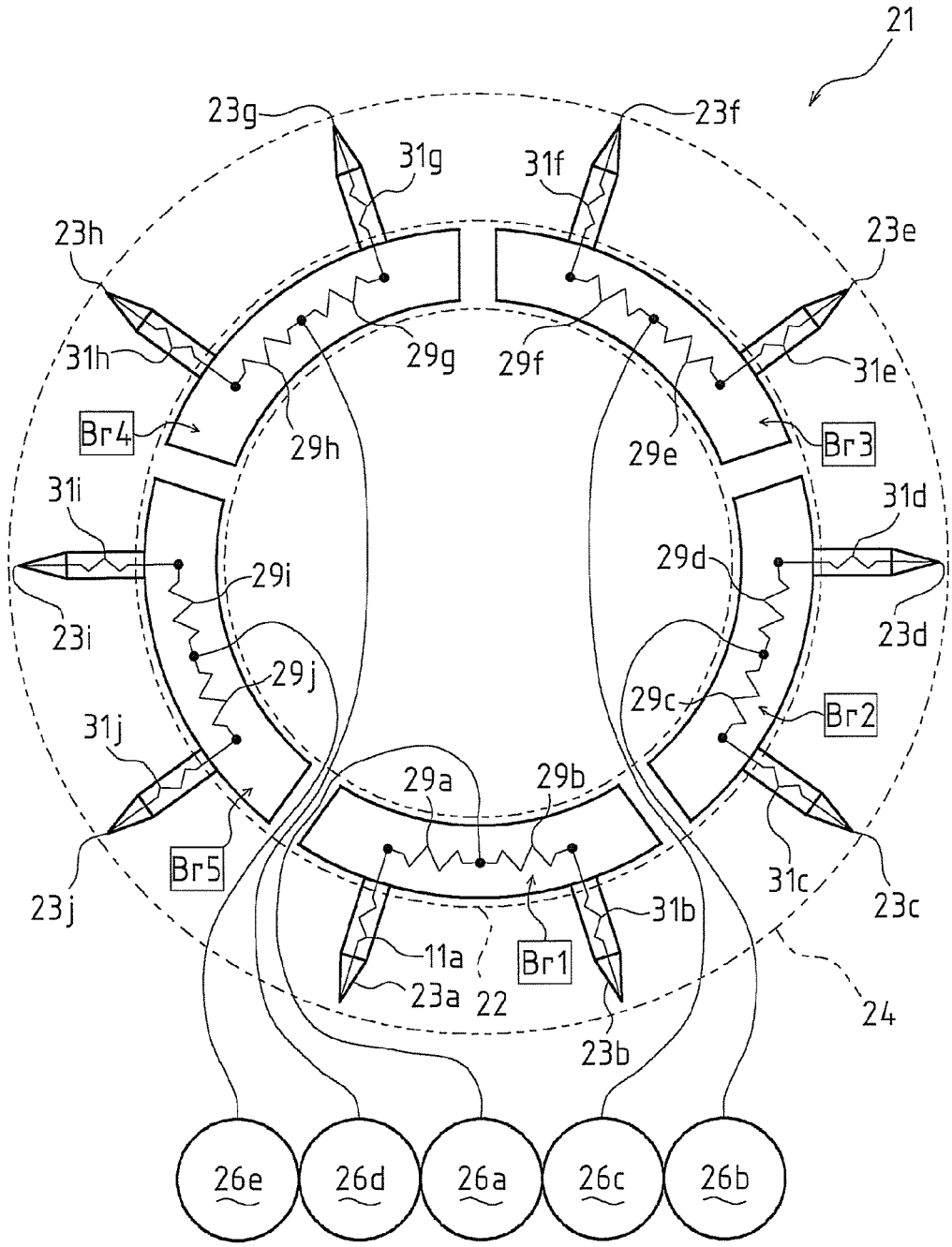
FIG. 6 depicts a second embodiment showing a blot preventing device according to the present invention.
Figure 7:
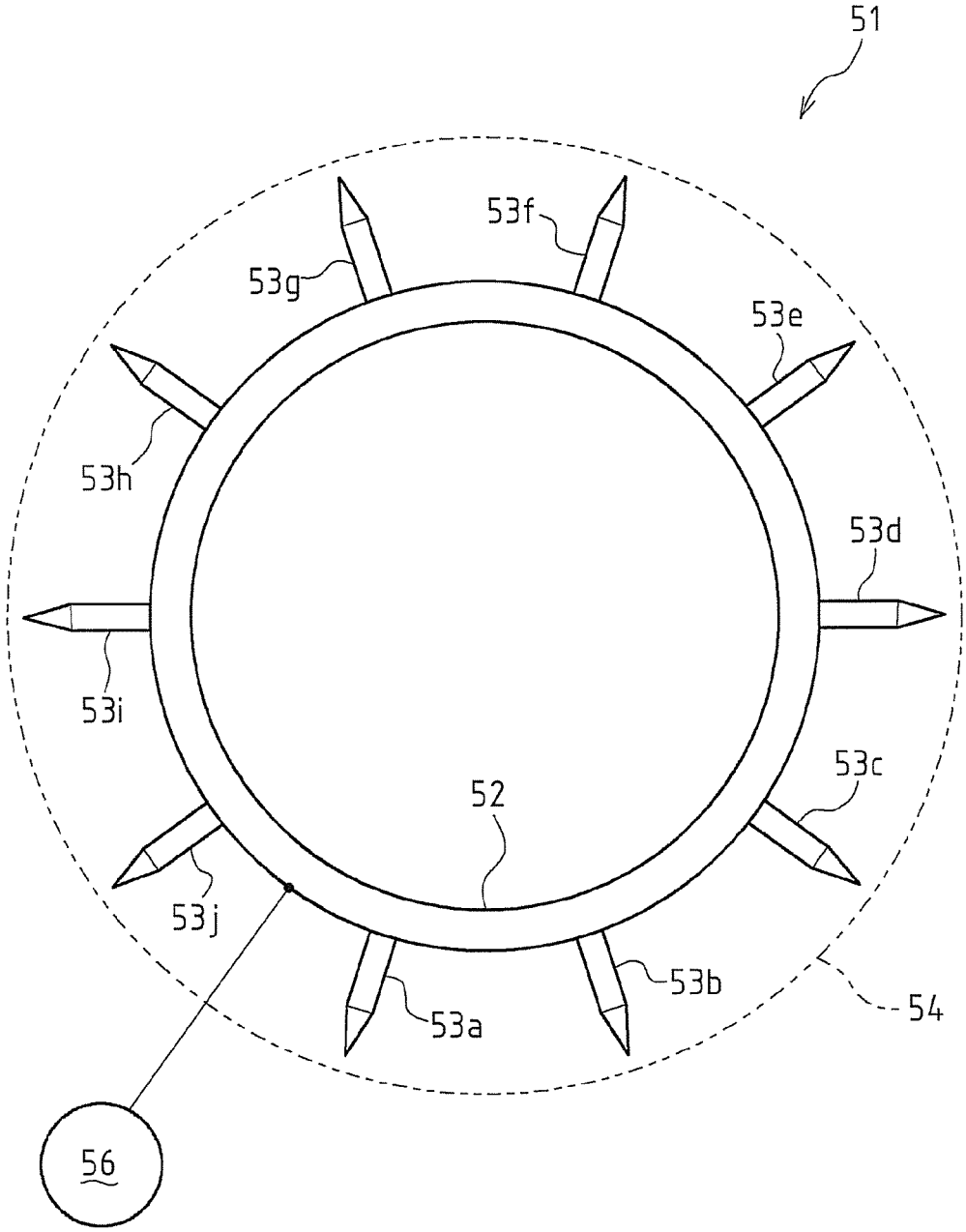
FIG. 7 depicts a conventional blot preventing device.
Figure 8:
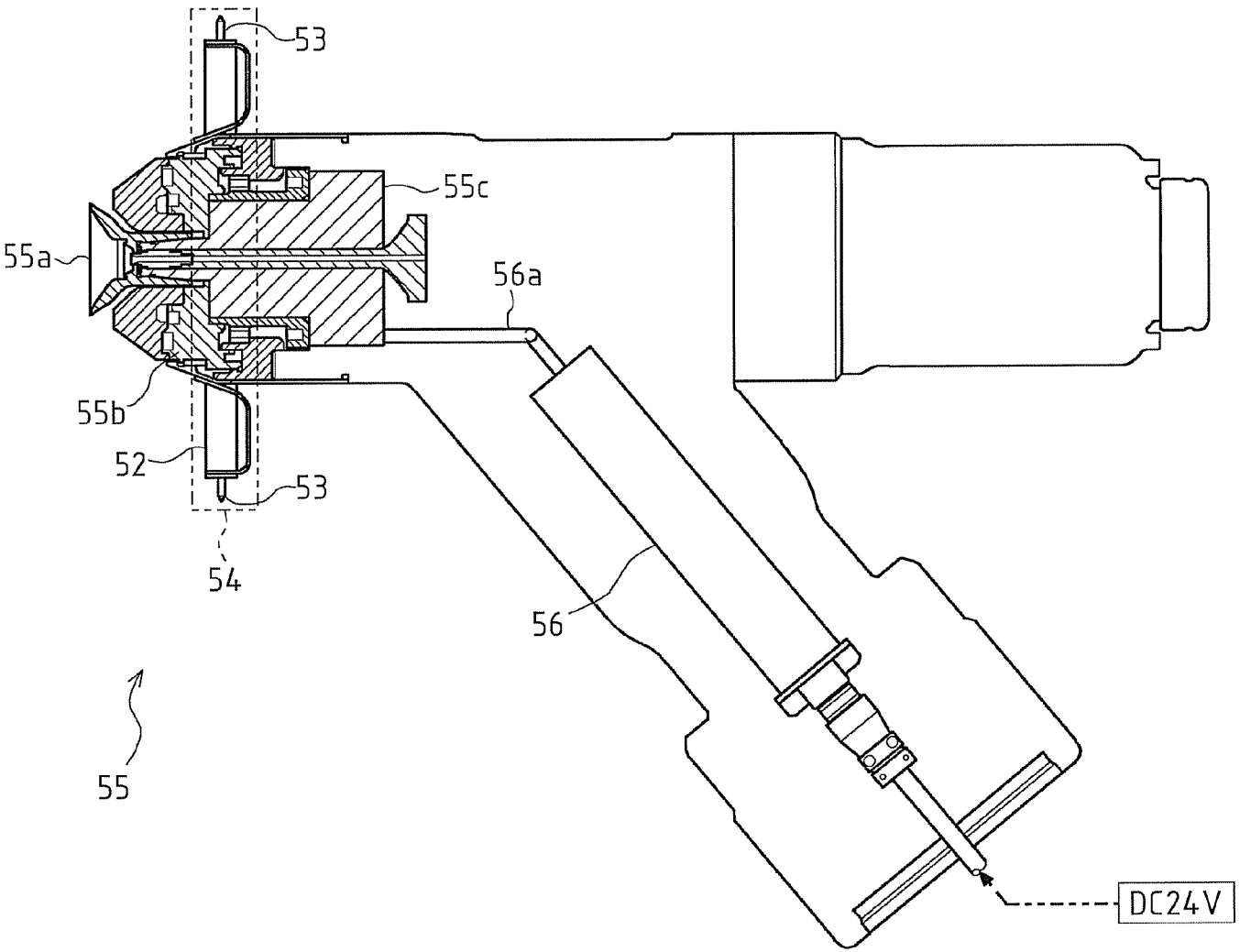
FIG. 8 is a side sectional view illustrating an electrostatic coating apparatus including the conventional blot preventing device.
Figure 9:
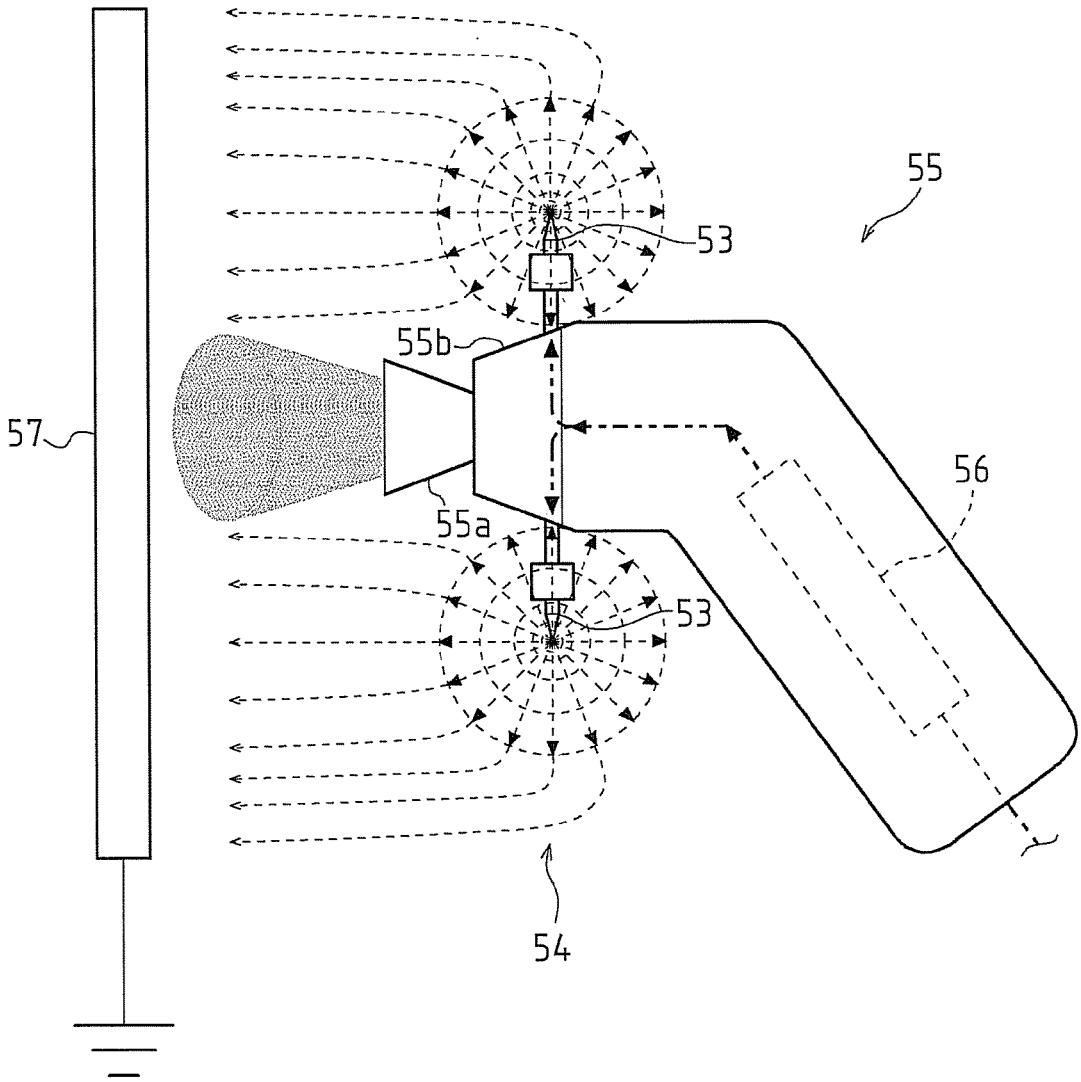
FIG. 9 depicts an electrostatic field formed by the blot preventing device.
Figure 10:
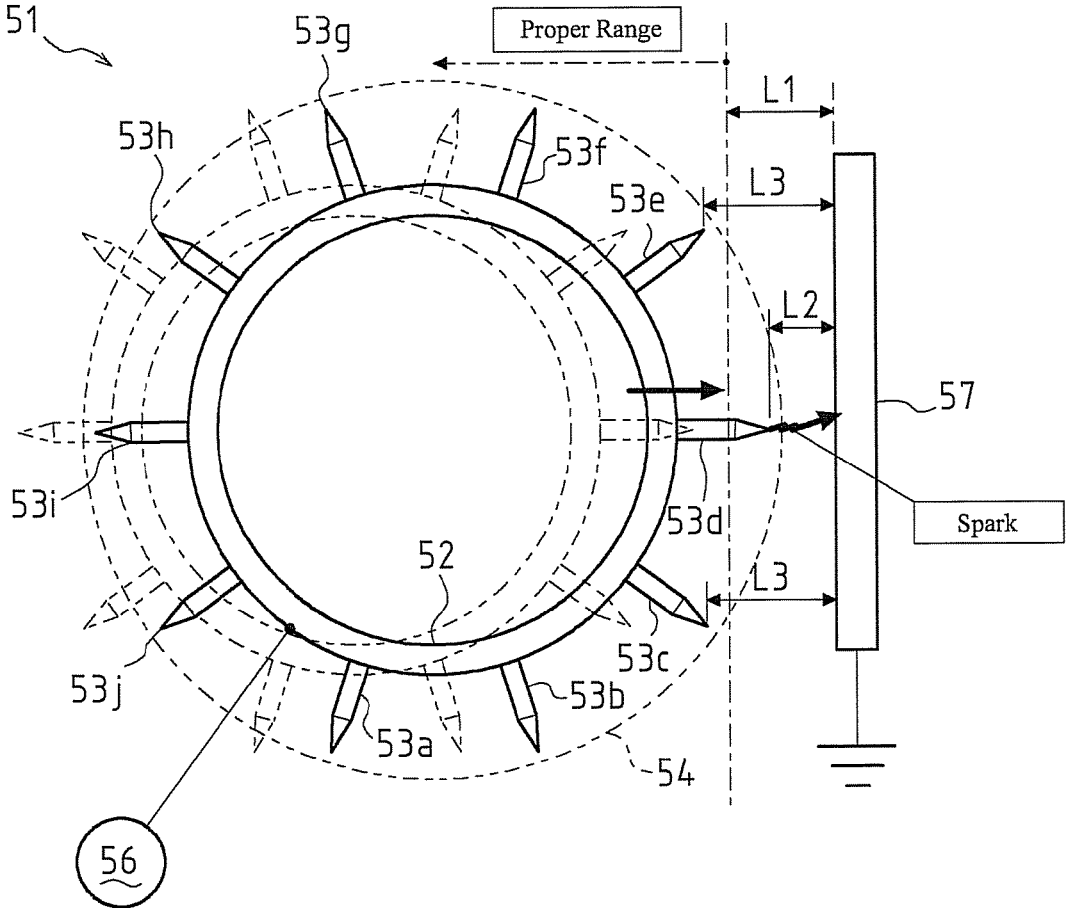
FIG. 10 depicts an approaching state of the conventional needle electrodes and grounded body.

As shown in FIG. 6, the device 21 includes a ring electrode part 24 provided with multiple needle electrodes 23 radiating from a ring base 22, each of which is arranged at spacing same distance from the adjacent electrodes.

The base 22 contains wires, and as shown in FIG. 6, one ends of the wires are connected to a high voltage generator 26, which has multiple (five) groups (26*a*, 26*b*, 26*c*, 26*d*, 26*e*, 26*f*). In this respect, the blot preventing device 21 of the second embodiment is different from the blot preventing device 1 of the first embodiment.

The other ends of the wires are connected to the electrodes 23 (23*a*, 23*b*, 23*c*, 23*d*, 23*e*, 23*f*, 23*g*, 23*h*, 23*i*, 23*j*).

In the electrode part 24, the inner wires arranged in the base 22 are divided into five blocks (blocks Br1, Br2, Br3, Br4, Br5 as depicted in FIG. 6), the each block (Br1 to Br5) has two electrodes 23. The blocks Br1 to Br5 are connected in a parallel manner to the generators 26*a* to 26*e*, respectively.

In the embodiment, the electrode part 24 is divided into five blocks, however, the dividing number is not limited and adjusted in accordance with the number of the needle electrodes, the size of the coating gun or the like.

In the inner wires in the blocks Br1 to Br5, the electrodes 23*a* to 23*j* are connected to the generators 26*a* to 26*e* through individual resistors 29 (29*a*, 29*b*, 29*c*, 29*d*, 29*e*, 29*f*, 29*g*, 29*h*, 29*i*, 29*j*), respectively.

In the inner wires of the electrodes 23*a* to 23*j*, the electrodes 23*a* to 23*j* have built-in resistors 31 (31*a*, 31*b*, 31*c*, 31*d*, 31*e*, 31*f*, 31*g*, 31*h*, 31*i*, 31*j*).

Thus, the individual control for the applied voltages is obtained, so that when the electrode 23*a* approaches to the grounded body 27 and high current flows therein, the output voltage of the generator 26*a* in the block Br1 where the electrode 23*a* belongs is adjusted to prevent the spark discharge without influencing on the other electrodes.

The generators 26*b* to 26*e* connected to the other electrodes 23*b* to 23*j* have separated wires, so that there are no influences on the applied voltages to the other electrodes 23*b* to 23*j* apart from the electrode 23*a*; as a result, the electrostatic fields formed by the electrodes 23*b* to 23*j* are maintained properly, thereby preventing the blot preventing performance from lowering.

Furthermore, it is possible to identify which electrode 23 approaches to the grounded body 27.

As explained above, in the electrode part 24 of the device 21, the generator 26 is composed of five generators 26*a* to 26*e*, and the electrodes 23*a* to 23*j* are divided into five (the same number as the generators 26) blocks Br1 to Br5 including two electrodes 23, each of the blocks Br1 to Br5 is connected to the generator 26*a* to 26*j*, respectively.

Thus, the voltage fluctuation occurred in a needle electrode does not influence on the other electrodes.

INDUSTRIAL APPLICABILITY

The present invention is applicable to an electrostatic coating apparatus including the blot preventing device in which the multiple needle electrodes are configured in the ring shape.

The invention claimed is:

1. An electrostatic coating apparatus, comprising:

a high voltage generator;

a bell cup directly electrically connected to the high voltage generator for electrostatic spraying; and a ring electrode positioned adjacently behind the bell cup, the ring electrode comprising an insulating ring base and multiple needle electrodes radiating from the ring base, the needle electrodes being electrically connected to the high voltage generator in a parallel manner through resistors positioned between the high voltage generator and the multiple needle electrodes.

2. The electrostatic coating apparatus according to claim 1, wherein the needle electrodes are connected in a parallel manner to the high voltage generator through individual resistors.

3. The electrostatic coating apparatus according to claim 2, wherein the electric resistances of the individual resistors are more than 1 MΩ.

4. The electrostatic coating apparatus according to claim 1, wherein the needle electrodes are divided into multiple blocks and in each block the multiple needle electrodes are connected in a parallel manner to the high voltage generator through block-by-block resistors.

5. The electrostatic coating apparatus according to claim 4, wherein the electric resistances of the block-by-block resistors are more than 1 MΩ.

6. The electrostatic coating apparatus according to claim 1, wherein each needle electrode is connected to an individual resistor having a resistance of greater than 1 MΩ, and wherein at least two adjacent needle electrodes are connected to a common resistor having a resistance of greater than 1 MΩ.

* * * * *

UNITED STATES PATENT AND TRADEMARK OFFICE

CERTIFICATE OF CORRECTION

PATENT NO. : 8,307,780 B2
APPLICATION NO. : 12/740756
DATED : November 13, 2012
INVENTOR(S) : Isamu Yamasaki et al.

It is certified that error appears in the above-identified patent and that said Letters Patent is hereby corrected as shown below:

Title Page, item (57), line 1, change "Intended is to" to --Intended to--;

Column 2, line 9, change "53 foam" to --53 form--;

Column 3, line 64, change "connected to the each" to --connected to each--;

Column 4, line 3, change "if the any electrodes" to --If any electrodes--;

Column 4, line 30, change "drop pf the conventional" to --drop of the conventional--;

Column 4, line 46, change "and foamed" to --and formed--;

Column 6, line 51, change "GRA current)." to --(1μA current).--;

Column 7, line 13, change "fowled" to --formed--.

Signed and Sealed this
Twenty-sixth Day of March, 2013

Teresa Stanek Rea
*Acting Director of the United States Patent and Trademark Office*